US005385248A

United States Patent [19]

Klein, Jr.

[11] Patent Number: 5,385,248

[45] Date of Patent: Jan. 31, 1995

[54] DECORATIVE MULTI-COMPONENT HARDWARE ITEMS AND METHOD OF ASSEMBLING THE SAME

[76] Inventor: Frederick H. Klein, Jr., P.O. Box 411, Oley, Pa. 19547

[21] Appl. No.: 254,347

[22] Filed: Jun. 6, 1994

[51] Int. Cl.[6] ..... A47F 5/00

[52] U.S. Cl. ..... 211/105.1; 211/16; 16/111 R; 16/DIG. 5; 16/DIG. 24

[58] Field of Search ..... 211/105.1, 123, 16; 248/251; 16/111 R, 114 R, DIG. 5, DIG. 24

[56] References Cited

U.S. PATENT DOCUMENTS

| | | | |
|---|---|---|---|
| 112,004 | 2/1871 | Alsop . | |
| 123,960 | 2/1872 | White | 16/111 R |
| 139,383 | 5/1873 | Goodsell | 16/111 R |
| 248,865 | 11/1881 | Leonard | 16/111 R |
| 457,977 | 8/1891 | Wilkening . | |
| 586,080 | 7/1897 | Thompson | 211/16 X |
| 1,190,453 | 7/1916 | Pease . | |
| 2,374,787 | 5/1945 | Spiegel et al. | 211/105.1 |
| 2,868,389 | 1/1959 | Friend | 211/123 |
| 4,729,484 | 3/1988 | McConnell . | |

FOREIGN PATENT DOCUMENTS 369030 2/1923 Germany .

*Primary Examiner*—Alvin C. Chin-Shue

*Assistant Examiner*—Sarah L. Purol

*Attorney, Agent, or Firm*—Caesar, Rivise, Bernstein, Cohen & Pokotilow, Ltd.

[57] ABSTRACT

Items of decorative hardware, e.g., handles, pulls, towel bars, tissue bars, etc., and a method of making the same. Each hardware item comprising an assembly of a pair of posts, a cross member, and an externally threaded rod. The cross member may comprise one integral elongate rod-like member or a plurality of separate sections disposed in a side-by-side array to form an elongated rod-like member. In any case the cross member has a decorative exterior surface, a pair of ends, and an internally threaded passageway extending longitudinally through it. Each of the posts has an under surface for securing the hardware item to a panel, e.g., a wall or a cabinet, and a decorative exterior surface including a side portion. Each of the side portions of the posts include an internally threaded bore. The posts are arranged to be oriented with respect to each other so that their side portions face each other with their internally threaded bores axially aligned. The externally threaded rod is threadedly received within the passageway of said cross member so that opposite end portions of it extend out of the ends of the cross member. Those extending end are then screwed into respective bores in the posts to cause the side portions of the posts to abut respective ends of the cross member to complete the assembly.

14 Claims, 2 Drawing Sheets

FIG. 1
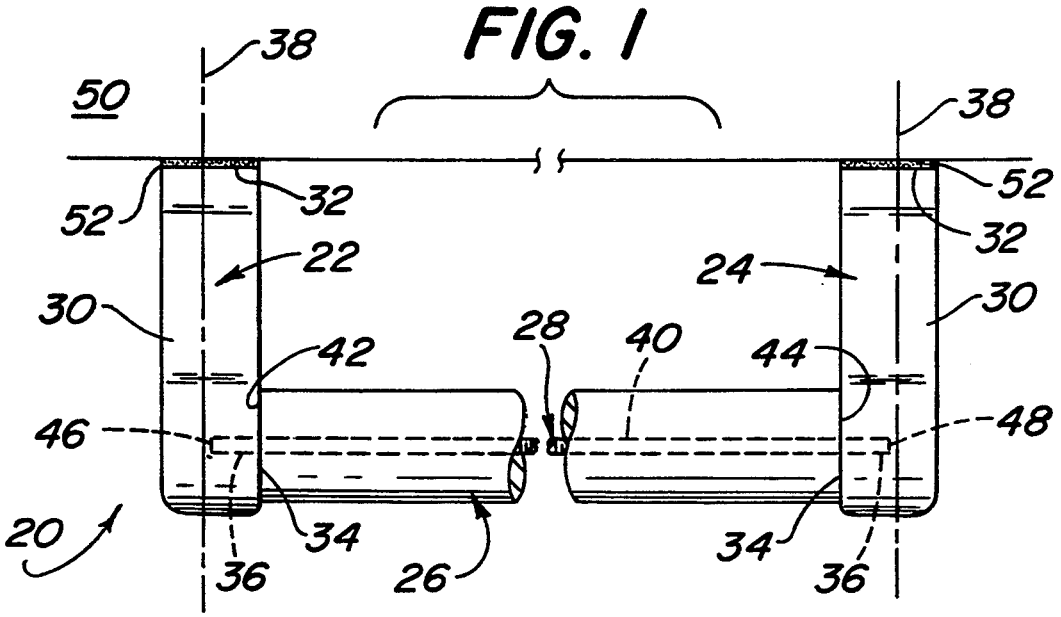
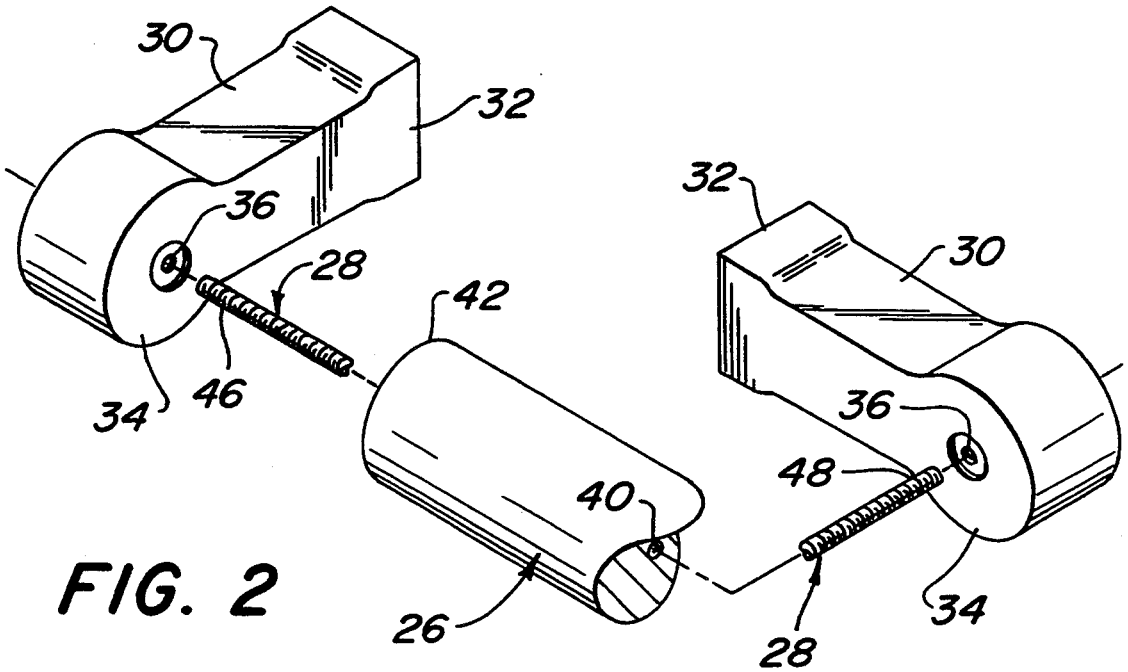
FIG. 2

DECORATIVE MULTI-COMPONENT HARDWARE ITEMS AND METHOD OF ASSEMBLING THE SAME

BACKGROUND OF THE INVENTION

This invention relates generally to hardware items, and more particularly to decorative hardware items having a pair of posts and an interconnecting cross member, such as handles, pulls, towel bars, tissue holders, grab bars, etc.

Today, a variety of decorative hardware items having a pair of posts and an interconnecting cross member are commercially available from various manufacturers. Such hardware is typically constructed as an integral unit from solid material or as an assembly of various components which are secured together at glue or other adhesive joints or utilizing threaded fasteners.

While such prior art components are suitable for their intended purposes they leave much to be desired from the standpoints of easy fabrication and/or assembly, ability to be assembled in a wide variety of configurations, and stability, e.g., resistance to accidental disassembly.

Various Letters Patent of the United States disclose towel bars and other decorative hardware items formed of plural components which are secured together and which exhibit the disadvantages of the prior art mentioned above, such as: U.S. Pat. Nos. 112,004 (Alsop) 457,977 (Wilkening) 586,080 (Thompson) 1,190,453 (Pease) 2,374,787 (Spiegel et al.); and 2,848,389 (Friend). German Patent No. 369030 discloses an item of decorative hardware made up of plural components which also suffers from those disadvantages.

OBJECTS OF THE INVENTION

Accordingly, it is a general object of this invention to provide decorative hardware items which overcome the disadvantages of the prior art.

It is another object of this invention to provide decorative hardware items made up of an assembly of various shaped and/or colored and/or textured components not heretofore accomplished.

It is still another object of this invention to provide decorative hardware items made up of an assembly of components of various materials not heretofore accomplished.

It is yet another object of this invention to provide decorative hardware items made up of plural components which are easy to assemble.

It is still another object of this invention to provide decorative hardware items made up of plural modular components.

SUMMARY OF THE INVENTION

These and other objects of this invention are achieved by providing a decorative hardware item for securement to a panel, e.g., a wall, a door or drawer of a cabinet, or any other member within a static structure, and methods of assembling those items.

Each of the items comprises an assembly of a pair of posts, a cross member, and an externally threaded rod. The cross member has a decorative exterior surface, a pair of ends, and an internally threaded passageway extending longitudinally through it between the ends. The cross member may be formed of one or plural sections disposed in a side-by-side array.

Each of the posts has an under surface and a decorative exterior surface including a side portion. Each of the side portions includes an internally threaded bore. The posts are arranged for fixed securement to the panel so that their under surfaces abut the panel and their side portions face each other, with the bores in the side portions being axially aligned.

The externally threaded rod is threadedly received within the internally threaded passageway extending through the cross member (or the plural sections making up the cross member) so that opposite end portions of the rod extend out of the ends of the cross member (or the plural sections making up the cross member) and are threadedly received within respective bores in the posts, whereupon the side portions of the posts abut respective ends of the cross member to complete the assembly.

In accordance with the method of this invention the hardware item is assembled by threadedly locating the externally threaded rod within the passageway of the cross member so that opposite end portions of it extend out of the ends of the cross member. One of the posts is then oriented so that the threaded bore in it is axially aligned with one extending threaded end of the externally threaded rod and that end is threadedly secured in the aligned bore so that the side portion of the one post abuts one end of the cross member. The other post is connected to the other end of the threaded rod in a similar manner.

When the hardware item is to include a cross member made up of plural sections those sections are assembled together in a side-by-side array by screwing them in a predetermined sequence along the externally threaded rod, whereupon one of the sections forms one end of the cross member and another of the sections forms the other end of the cross member, with opposite ends of the threaded rod extending from the end sections.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a top plan view of towel rack constructed in accordance with this invention shown mounted on a panel;

FIG. 1 is an enlarged, exploded, isometric view of the towel rack shown in FIG. 1;

FIG. 2 is a partial sectional view of the towel rack shows, in FIGS. 1 and 2 in its fully assembled state.

DETAILED DESCRIPTION OF THE PREFERRED EMBODIMENTS

Figure 4:
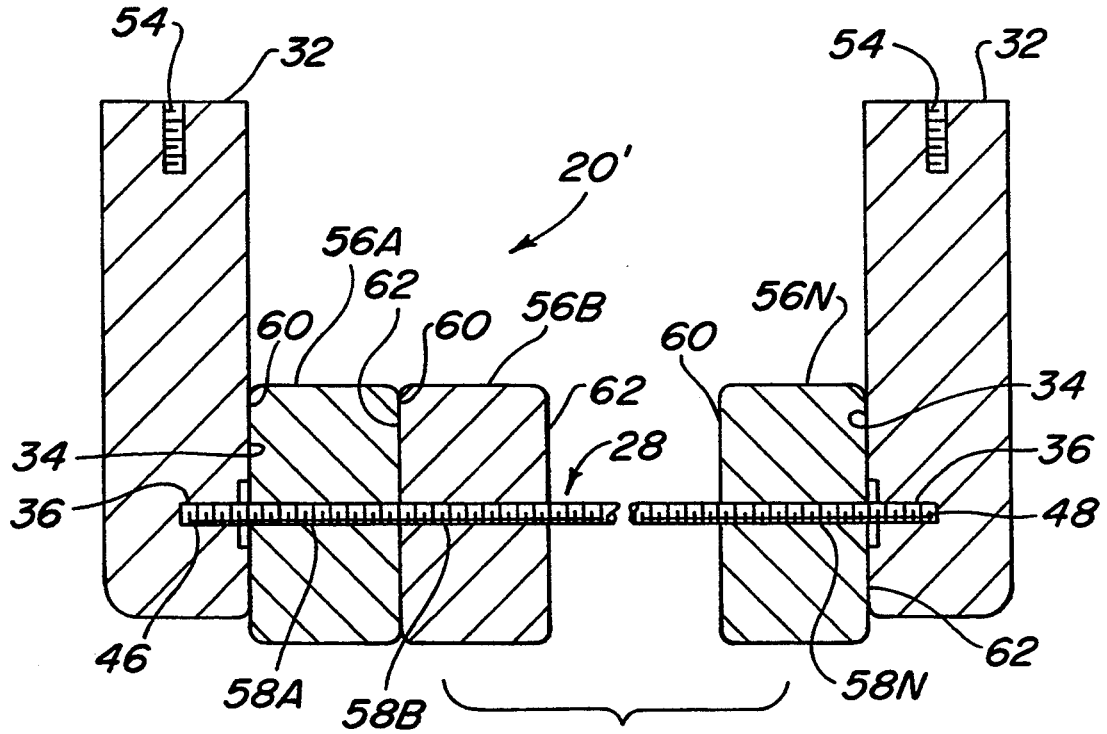
FIG. 4 is a partial sectional view, similar to that of FIG. 3, but showing a handle constructed in accordance with this invention.

Referring now to various figures of the drawing where like reference numerals refer to like parts there is shown at 20 in FIG. 1, a decorative hardware constructed in accordance with this invention. The item 20 shown herein is in the form of a towel bar, but may be a cabinet handle or pull, a toilet tissue holder, or any other similarly shaped item. To that end the hardware items 20 constructed in accordance with the teachings of this invention basically comprises a pair of posts 22 and 24, a cross member 26, and an externally threaded rod 28. The cross member may be an integral or onepiece rod-like member, such as shown in FIG. 1, or may be formed of plural sections which are disposed in a side-by-side array to form an elongated rod-like member, such as shown in FIG. 4. In any case the cross member 26 is an elongated member, either linear (as shown), or arcuate (not shown), with the length of the member, i.e., the distance between its ends, being selected in accordance with the type of hardware item to be formed. For example, when the hardware item to be formed is a towel bar the cross member is linear and of any conventional length, e.g., 18 inches (45.7 cm) long. When the hardware item is to be a toilet tissue holder the cross member is also preferably linear and of any conventional length, e.g., 6.5 inches (16.5 cm) long. When the hardware item is to be a handle or pull the cross member may be linear or even slightly arcuate, with its length also being conventional, e.g., 4 inches (10.2 cm) long.

The exterior surface of the cross member 26 preferably exhibits a decorative aesthetically pleasing appearance. Thus, the exterior surface may be of a particular color, e.g., gold, silver, bronze, white, beige, etc., and/or of any particular finish, e.g., gloss, matte, knurled, scalloped, etc. The material making up the cross member 26 may be selected from any suitable materials, such as metals, plastics, ceramics, woods, or any combination thereof to provide the desired appearance, or may be coated or covered with any suitable material to provide that appearance.

The posts 22 and 24 shown herein are of identical construction to each other and each includes an upright portion 30 and a generally planar base portion 32. The exterior surfaces of each of the posts 22 and 24 includes a side portion or surface 34 having an internally threaded bore 36 extending therein. Each bore 36 is oriented so that it extends perpendicularly to the longitudinal axis 38 of the upright portion.

The shape of the upright portion of each post is purely a matter of design so that it can be of any shape, e.g., cylindrical, parallelepiped, or asymmetrical, so long as it includes a bore 36 oriented perpendicularly to the longitudinal axis of the upright portion. Moreover, the exterior surface of each post, like that of the cross member, is selected to provide a decorative aesthetically pleasing appearance. Thus, like the material making up the cross member 26, the material making up each post 22 and 24 may be selected from any suitable materials, such as metals, plastics, ceramics, woods, or any combination thereof to provide the desired appearance.

It should be pointed out at this juncture that the posts 22 and 24 need not be identical in shape, appearance or construction. For example, if desired they may be mirror images of each other, or may be asymmetrical. In any case the two posts 22 and 24 are oriented so that their bores 36 face each other in axial alignment. This orientation enables the cross member 28 to be connected to the posts to complete the assembly of the hardware item 20.

Figure 3:
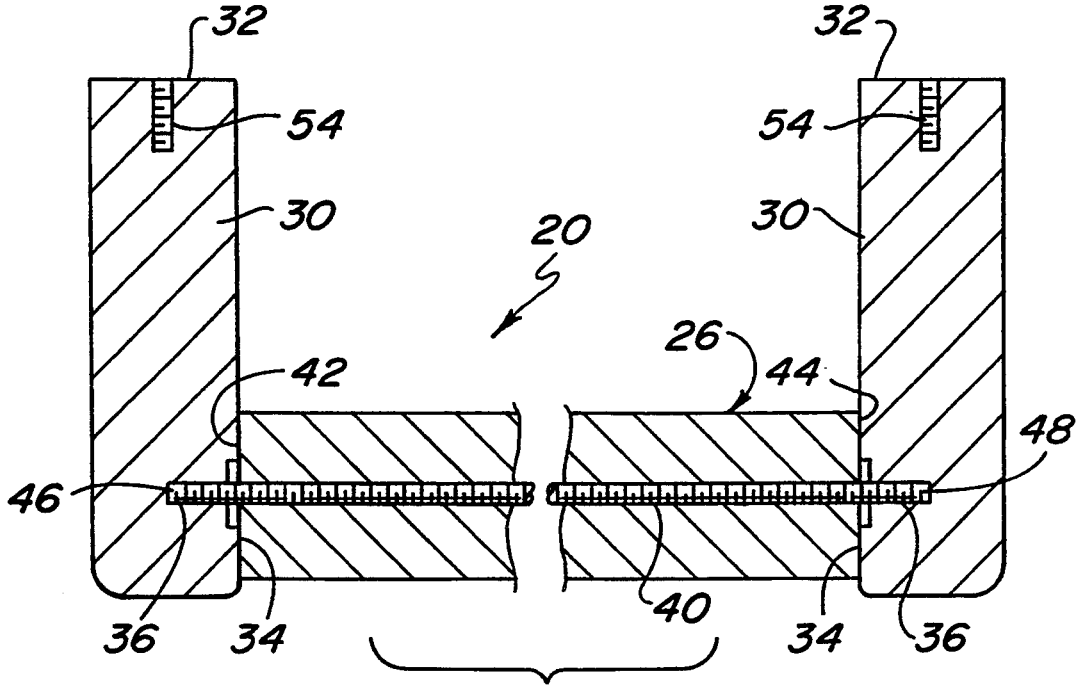

In particular, the connection of the cross member to the posts is accomplished by means of the externally threaded rod 28. The rod is linear and is threaded along its entire length. The rod 28 may be formed of any suitable material, e.g., steel or plastic. The elongated cross member 26 includes a linear, longitudinal passageway 40 extending fully therethrough, i.e., between the ends 42 and 44 of the cross member. The passageway is internally threaded to mate with the threads on the rod so that the rod 24 can be threadedly received (screwed) in the passageway 40. In particular, the rod is arranged to be screwed into the passageway in the cross member until its opposite end portions 46 and 48 (FIGS. 3 and 4) extend out the ends 42 and 44, respectively, of the cross member by an approximately equal distance. Once this has been accomplished the extending threaded ends of the rod 28 can be screwed into the threaded bores 36 in the posts until the end faces of the cross member abut the side surface 34 of the posts 22 and 24 to complete the assembly of the hardware item 20.

The item 20 is now ready to be attached to the wall or cabinet panel 50. As shown in FIG. 1 this action can be accomplished by use of an adhesive 52 layer applied to the base surface 32 of each post. Alternatively, other fastening means, such as screws, bolts, nails, staples, rivets, etc., can be used to secure the assembled hardware item to the panel 50. For example, as can be seen clearly in FIG. 3, each post includes an internally threaded bore 54 extending perpendicularly into the post from the bottom of the base surface. The bore is arranged to accept a mounting screw or bolt (not shown).

In FIG. 4 there is shown an alternative embodiment of hardware item 20' constructed in accordance with this invention. That item is in most respects identical in construction to the item 20, so that the same reference numerals are used to designate similar components or features. However, the hardware item 20' differs from the item 20 in that the cross member of item 20' is formed of plural discrete sections, whereas the cross member of item 20 is formed of one integral member. Thus, as can be seen in FIG. 4 the cross member includes plural, discrete, cylindrical sections 56A–56N. Each section 56A–56N includes an internally threaded passageway 58A to 58N, respectively, extending through the section between the end surfaces 60 and 62 of the section. The number (N) of sections making up the cross member is purely a matter of design choice. Moreover, each section may be of identical shape or of different shape, and each may be of the same color and/or finish or of different color and/or finish, depending upon the desired appearance sought. In any case the sections 56A–56N are arranged to be secured together to form the cross member. This is accomplished by screwing them in sequence onto the externally threaded rod 28 so that they are disposed in a side-by-side array, with their end surfaces 60 and 62 abutting or lying immediately adjacent each other, and with the end portion 46 of the rod 28 extending beyond the end surface 60 of the section 56A and with the end portion 48 of the rod 28 extending beyond the end surface 62 of the section 56N by an equal distance. The sequence that the sections 54A to 54N are secured together on the rod 28 is purely a matter of design choice. For example, the sections may be disposed in a sequence so that the end sections are of a first color or finish and the next successive sections are of a contrasting or different color or finish, and with the sections alternating along the length of the rod.

In any case once the sections have been secured together on the externally threaded rod 28 the posts 22 and 24 may then be secured to the extending ends 46 and 48 in the same manner as described heretofore.

It should be pointed out at this juncture that the manner and sequence in which the various components making up the hardware items of this invention can be secured to one another can be different than that described heretofore, e.g., one end 46 or 48 of the rod 28 is screwed into a bore in one of the posts 22 or 24 and then the single cross member or multiple sections of the cross member is/are screwed onto the rod, and then the other post secured to the rod. The flexibility of the assembly process to accommodate the desires/needs of the assembler is one of the major attributes of this invention.

As should be appreciated from the foregoing the hardware items of this invention can be readily assembled quickly and easily without requiring any special tools or techniques. Moreover, by virtue of the modular nature of the hardware's components, hardware items of various sizes, shapes, and surface appearances can be readily assembled. Once assembled such items are resistant to accidental disassembly, yet can be readily disassembled, when desired.

Without further elaboration the foregoing will so fully illustrate my invention that others may, by applying current or future knowledge, adapt the same for use under various conditions of service.

I claim:

1. An item of decorative hardware for securement to a panel, said item comprising an assembly of a pair of posts, a cross member, and an externally threaded rod, said cross member having a decorative exterior surface, a pair of ends, and an internally threaded passageway extending longitudinally through said member between said ends, each of said posts having an under surface and a decorative exterior surface including a side portion, each of said side portions including an internally threaded bore, said posts being arranged for fixed securement to said panel so that said under surfaces abut said panel and said side portions face each other with said bores being axially aligned, said externally threaded rod being threadedly received within said passageway of said cross member so that opposite end portions of said externally threaded rod extend out of said ends of said cross member and are threadedly received within respective bores in said posts, whereupon said side portions of said posts abut respective ends of said cross member to complete said assembly.

2. The decorative hardware item of claim 1 wherein said cross member is a unitary elongated member.

3. The decorative hardware item of claim 1 wherein said cross member comprises a plurality of sections disposed in a side-by-side array.

4. The decorative hardware item of claim 1 wherein said hardware comprises a handle.

5. The decorative hardware item of claim 1 wherein said hardware comprises a towel bar.

6. The decorative hardware item of claim 2 wherein said hardware comprises a handle.

7. The decorative hardware item of claim 2 wherein said hardware comprises a towel bar.

8. The decorative hardware item of claim 3 wherein said hardware comprises a handle.

9. The decorative hardware item of claim 3 wherein said hardware comprises a towel bar.

10. A method of assembling an item of decorative hardware comprising a pair of posts, a cross member, and an externally threaded rod, said cross member having a decorative exterior surface, a pair of ends, and an internally threaded passageway extending longitudinally through said member between said ends, each of said posts having an under surface and a decorative exterior surface including a side portion, each of said side portions including an internally threaded bore, said method comprising threadedly locating said externally threaded rod within said passageway of said cross member so that opposite end portions of said externally threaded rod extend out of said ends of said cross member, orienting one of said posts so that the threaded bore in said one post is axially aligned with one extending threaded end of said externally threaded rod and threadedly securing said one end in said aligned bore so that said side portion of said one post abuts one end of said cross member, and orienting the other of said posts so that the threaded bore in said other post is axially aligned with the other extending threaded end of said externally threaded rod and threadedly securing said other end in said aligned bore so that said side portion of said other post abuts the other end of said cross member to complete said assembly.

11. The method of claim 10 wherein said cross member is formed by assembling plural sections together in a side-by-side array, said sections being assembled by screwing them in a predetermined sequence along said externally threaded rod, whereupon one of said sections forms one end of said cross member, with said one end of said rod extending there from, and whereupon another of said sections forms the other end of said cross member, with said other end of said rod extending therefrom.

12. The method of claim 10 wherein said cross member and said posts are selected to provide a desired external appearance.

13. The method of claim 11 wherein said plural sections of said cross member and said posts are selected to provide a desired external appearance.

14. The method of claim 13 wherein at least one of said plural sections has a different surface appearance than at least another of said plural sections, and wherein said at least one and said at least another of said sections are disposed in a predetermined sequence.

* * * * *